US005246412A

United States Patent [19]

Chen

[11] Patent Number: 5,246,412

[45] Date of Patent: Sep. 21, 1993

[54] SELF-ENERGIZING SKI-PRACTICING DEVICE

[76] Inventor: Meng S. Chen, No. 1-18, Tu Ku Village, Jen Te Hsiang, Tainan Hsien, Taiwan

[21] Appl. No.: 903,884

[22] Filed: Jun. 25, 1992

[51] Int. Cl.[5] ..... A63B 22/00

[52] U.S. Cl. ..... 482/70; 482/51

[58] Field of Search ..... 482/63, 70, 51, 4, 5, 482/8, 9

[56] References Cited

U.S. PATENT DOCUMENTS

| | | | |
|---|---|---|---|
| 3,582,069 | 6/1971 | Flick | 482/70 |
| 4,298,893 | 11/1981 | Holmes | 482/63 |
| 4,613,129 | 9/1986 | Schroeder et al. | 482/63 |
| 4,659,077 | 4/1987 | Stropkay | 482/70 |
| 4,867,443 | 9/1989 | Jensen | 482/70 |

*Primary Examiner*—Stephen R. Crow

[57] ABSTRACT

A self-energizing ski-practicing device includes a front base frame, a rear base frame, and a pair of longitudinal members mounted between the front and rear base frames with a pedal slidably mounted on each longitudinal member. A shaft is rotatably mounted on the front base frame. A driving wheel is mounted at the center of the shaft. A generator is mounted on the front base frame and is electrically connected with a computer means and has a wheel connected to the driving wheel. A transmission assembly is provided so that sliding movements of the pedals are transferred to a single directional rotation of the driving wheel, which in turn energizes the generator to supply power to the computer means.

1 Claim, 2 Drawing Sheets

SELF-ENERGIZING SKI-PRACTICING DEVICE

BACKGROUND OF THE INVENTION

The present invention relates to a ski-practicing device and, more particularly, to an improved ski-practicing device which can be self-energized to supply power to a computer means which is generally equipped with an exerciser to display the speed or pulse rate of the practicer.

A computer means is widely applied on exercisers to display the user's simulated speed and pulse rate and/or to control the resistance of the exercisers. However, a computer means requires an external power source. The invention provides a self-energizing ski-practicing device to supply power to the computer means via the motions of the user instead of using a conventional external power source.

SUMMARY OF THE INVENTION

A self-energizing ski-practicing device in accordance with the present invention generally includes a front base frame, a rear base frame, and a pair of longitudinal members mounted between the front and rear base frames with a pedal slidably mounted on each longitudinal member. A post extends upward from the front base frame with a computer means mounted thereon.

A shaft is rotatably mounted on the front base frame. A driving wheel is mounted on the center of the shaft. Also mounted at the front base frame is a generator which is electrically connected with the computer means and has a wheel connected to the driving wheel via a belt. On both sides of the driving wheel a barrel is mounted on the shaft via a reverse idler gear shaft bearing so that the driving wheel is only rotatable in one direction.

A transmission assembly consisting of rollers and cables is provided so that sliding movements of the pedals are transferred to a single directional rotation of the driving wheel, which in turn energizes the generator to supply power to the computer means.

Other advantages and novel features of the invention will become more apparent from the following detailed description when taken in conjunction with the accompanying drawings.

DETAILED DESCRIPTION OF THE PREFERRED EMBODIMENTS

Figure 1:
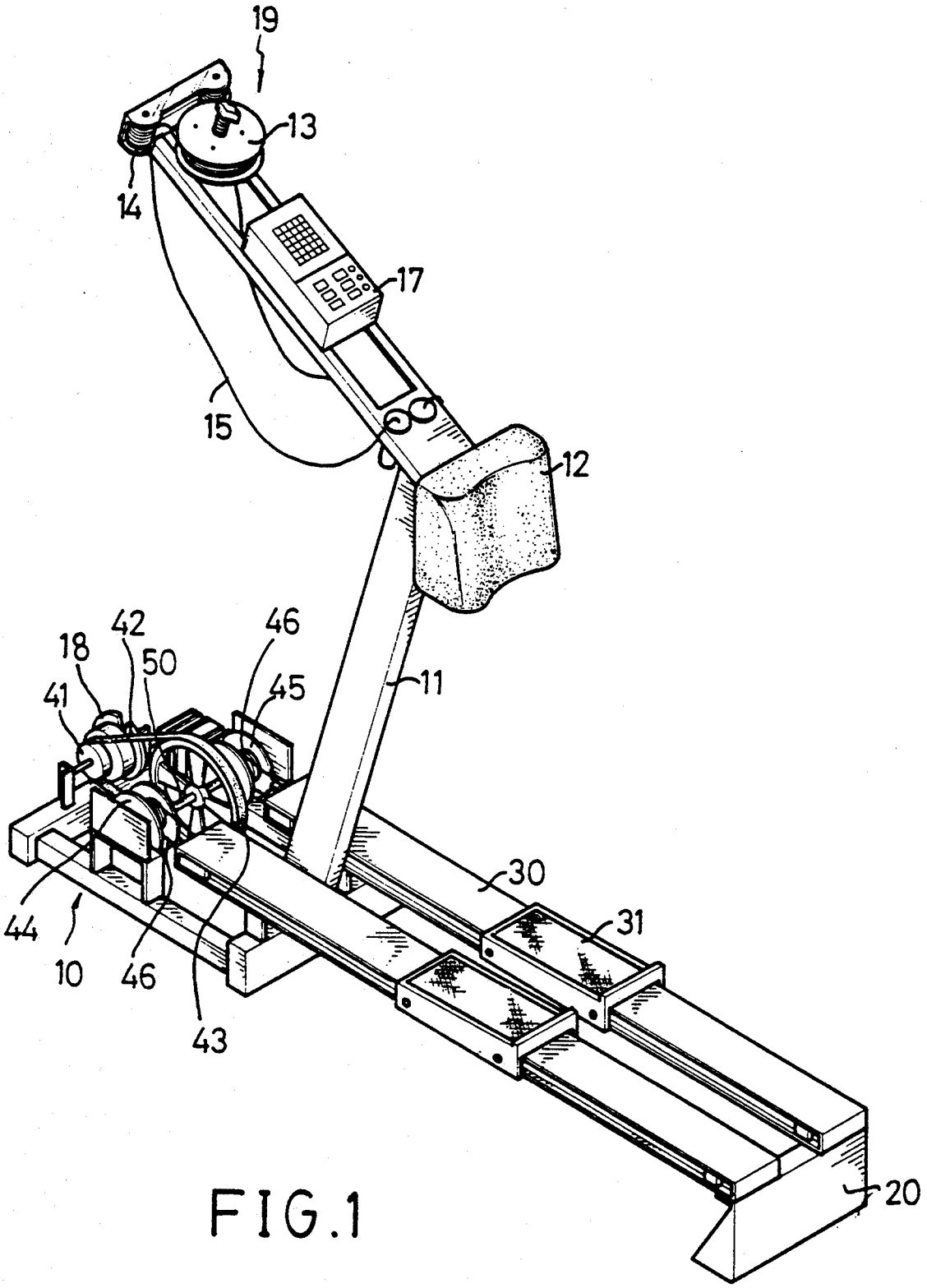
FIG. 1 is a perspective view of a self-energizing ski-practicing device in accordance with the present invention.

Referring to FIG. 1, a self-energizing ski-practicing device in accordance with the present invention generally includes a front base frame 10, a rear base frame 20, and a pair of longitudinal members 30 mounted between the front and rear base frames 10 and 20. A pedal 31 is slidably mounted on each longitudinal member 30. A post 11 extends upward from the front base frame 10 with a pad 12, a computer means 17, and an arm training means 19 mounted thereon. The computer means 17 is adapted to display the simulated speed, the pulse rate, and other data of the practicer. The arm training means

19 includes two ropes 15 wound around two rollers 14 and a pulley 13.

Figure 2:
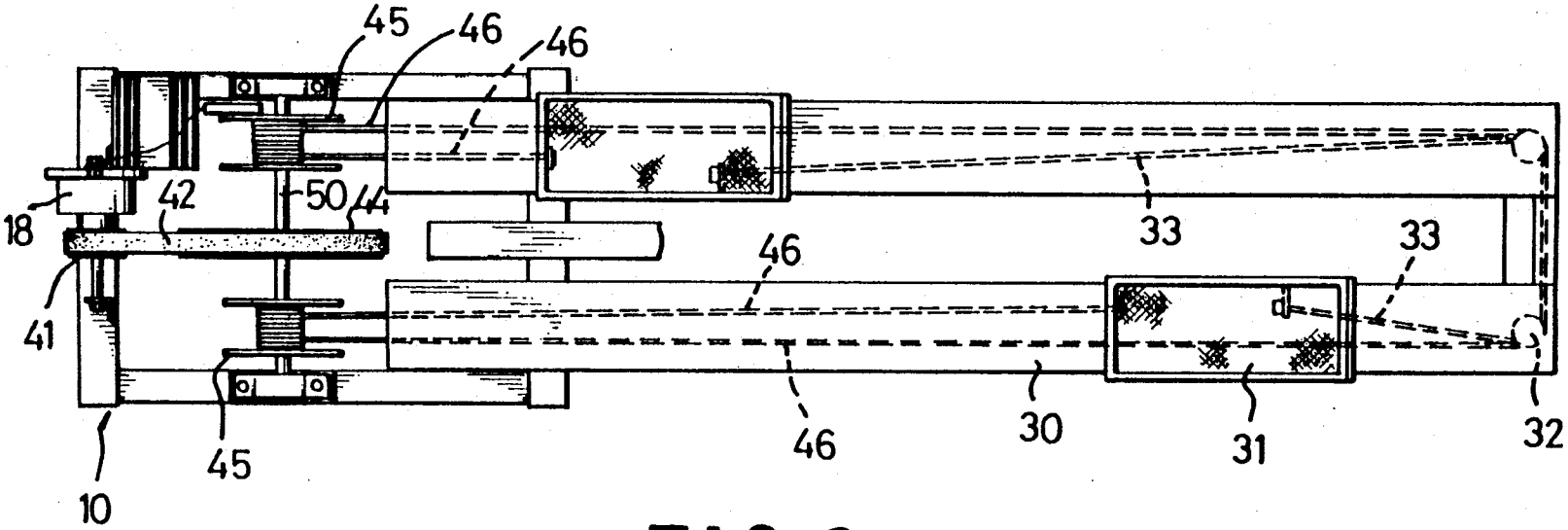
FIG. 2 is a schematic top plan view of the self-energizing ski-practicing device with a post thereof omitted for clarity.

Referring to FIG. 2, a shaft 50 is rotatably mounted on the front base frame 10. A driving wheel 44 is mounted on the center of the shaft 50. Also mounted on the front base frame 10 is a generator 18 which is electrically connected with the computer means 17 and has a wheel 41 connected to the driving wheel 44 via a belt 42. On both sides of the driving wheel 44 a barrel 45 is mounted on the shaft 50 via a reverse idler gear shaft bearing (not shown) so that the wheel 44 is only rotatable in one direction.

Figure 3:
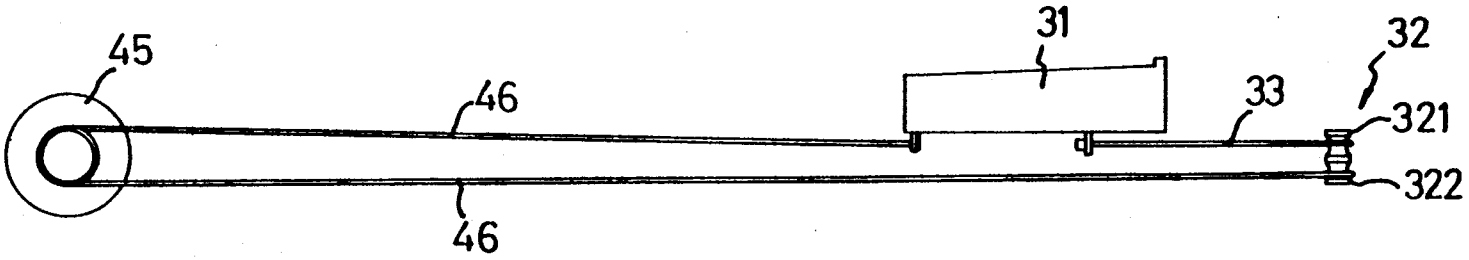
FIG. 3 is a schematic side view showing the arrangement of the pedal means of the ski-practicing device.

Still referring to FIG. 2, and further to FIG. 3, two roller pairs 32 each consisting of first and second rollers 322 and 321 are respectively disposed adjacent to the rear base frame 20. A first cable 46 has one end attached to one of the pedals 31. The first cable 46 winds around the associated barrel 45, then loops around the first rollers 322, winds around the other barrel 45, and has its other end attached to the other pedal 31. A second cable 33 has one end securely attached to one of the pedals 31, loops around the second rollers 321 and has its other end attached to the other pedal 31.

By such an arrangement, when a user stands on the pedals and practices the skiing motions, slide movements of the pedals are transferred to a single rotation of the driving wheel, which in turn energizes the generator 18 to supply power to the computer means 17.

Incidentally, the user may change the resistance of the pedals by changing the magnetic resistance of the generator, thereby providing an additional function as an resistance-variable exerciser.

It is appreciated that the cables and the rollers, as a whole, can be deemed as a transmission assembly, of which many other possible modifications and variations can be made without departing from the spirit of the invention. For example, the cables can be replaced with chains. The two roller pairs can be replaced with a roller pair located at a middle of the rear base frame.

I claim:

1. A ski-practicing device comprising a front base frame, a rear base frame, and a pair of longitudinal members mounted between the front and rear base frames, a pedal being slidably mounted on each said longitudinal member, a post extending upward from said front base frame with an arm training means mounted thereon, the improvement comprising:

a computer means being mounted on said post, a generator being mounted on said front base frame and electrically connected to said computer means, a shaft being rotatably mounted on said front base frame, a driving wheel being mounted on said shaft and only rotatable in one direction for energizing said generator, a pair of barrels being mounted on said shaft in front of each said longitudinal member, a transmission assembly being provided to connect said barrels to said pedals, said transmission assembly including first and second pairs of rollers provided adjacent to said rear base frame, a first cable having one end attached to one of said pedals, said first cable being wound around the associated barrel, then looped around said first rollers, wound around the other said barrel, and finally having its other end attached to the other said pedal, a second cable having one end securely attached to one of said pedals, said second cable being looped around said second rollers and having its other end attached to the other said pedal whereby sliding movements of said pedals are transferred to a single direction rotational movements of said driving wheel to energize said generator to supply power to said computer means.

* * * * *